US010997918B2

(12) United States Patent
Yamato et al.

(10) Patent No.: US 10,997,918 B2
(45) Date of Patent: May 4, 2021

(54) METHOD FOR DRIVING DISPLAY DEVICE AND DISPLAY DEVICE

(71) Applicant: SHARP KABUSHIKI KAISHA, Sakai (JP)

(72) Inventors: Asahi Yamato, Sakai (JP); Hikaru Kuki, Sakai (JP); Akira Nomura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/042,874

(22) PCT Filed: Mar. 30, 2018

(86) PCT No.: PCT/JP2018/013799

§ 371 (c)(1),
(2) Date: Sep. 28, 2020

(87) PCT Pub. No.: WO2019/187062

PCT Pub. Date: Oct. 3, 2019

(65) Prior Publication Data

US 2021/0020103 A1 Jan. 21, 2021

(51) Int. Cl.
*G09G 3/3241* (2016.01)

(52) U.S. Cl.
CPC ... *G09G 3/3241* (2013.01); *G09G 2300/0842* (2013.01); *G09G 2310/06* (2013.01); *G09G 2320/0247* (2013.01); *G09G 2330/028* (2013.01)

(58) Field of Classification Search
None
See application file for complete search history.

(56) References Cited

U.S. PATENT DOCUMENTS

| | | | |
|---|---|---|---|
| 2013/0321371 | A1 | 12/2013 | Koyama |
| 2017/0116922 | A1 | 4/2017 | Jung et al. |
| 2017/0116946 | A1 | 4/2017 | Nakatani et al. |

FOREIGN PATENT DOCUMENTS

| | | | |
|---|---|---|---|
| JP | 2006-065148 | A | 3/2006 |
| JP | 2006-084758 | A | 3/2006 |
| JP | 2012-058443 | A | 3/2012 |
| JP | 2017-161945 | A | 9/2017 |
| WO | 2015/199049 | A1 | 12/2015 |

*Primary Examiner* — Aneeta Yodichkas
(74) *Attorney, Agent, or Firm* — ScienBiziP, P.C.

(57) ABSTRACT

When an active matrix type display device using an electro-optical element such as an organic EL element is driven at a low frequency, there is a problem in that flicker occurs. Provided are a method of driving a display device and a display device in which occurrence of flicker can be suppressed, in drive of the display device for which any one of a high frequency drive and a low frequency drive can be selected, if a power supply voltage difference between a drive power supply and a cathode power supply in a case where the display device is driven in the low frequency drive is smaller than a power supply voltage difference in a case where the display device is driven in the high frequency drive.

10 Claims, 5 Drawing Sheets

METHOD FOR DRIVING DISPLAY DEVICE AND DISPLAY DEVICE

TECHNICAL FIELD

The disclosure relates to a method of driving a display device including pixels arranged in a matrix, and also relates to a display device.

BACKGROUND ART

Current-drive type organic EL elements are well known in an example of electro-optical elements included in pixels arranged in a matrix. In recent years, active development of organic EL displays including organic ELs in pixels is underway as a display incorporating a display device increases in size and decreases in thickness, which attracts attention in terms of vividness of displayed images.

In particular, the display device is often an active matrix type display device in which a current-drive type electro-optical element is provided in each pixel together with a switching element such as a thin film transistor (TFT) to individually control the electro-optical element so that the electro-optical element is controlled for each pixel. This is because, if the display device is an active matrix type display device, an image can be displayed with higher-resolution than a passive type display device.

Here, a connection line formed along a horizontal direction for each row, and a data line and a power supply line formed along a vertical direction for each column are provided in an active matrix type display device. Each of the pixels includes an electro-optical element, a connection transistor, a drive transistor, and a capacitance. The connection transistor is turned on if a voltage is applied to the connection line, and data can be written if the capacitance is charged with a data voltage (data signal) on the data line. The drive transistor is turned on by the data voltage with which the capacitance is charged, and the current from the power supply line is caused to flow through the electro-optical element so that the pixels can emit light.

Furthermore, when an active matrix type display device forms an image by causing pixels arranged on the display device to emit light according to the data signal, it is possible to display a moving image and the like if one frame in which the image is formed by one scan operation of the connection line in the vertical direction is driven at a specific frequency (specific frequency).

Here, the specific frequency may be set to a high frequency during a normal operation such as an operation performed in a case where a user of a mobile information terminal or the like incorporating the display device operates the mobile information terminal or the like to view image information from the display device, and may be set to a low frequency in a case where, for example, during standby, the user does not need to actively acquire the image information from the display device. As disclosed in PTL 1 and PTL 2, the power consumption of the display device can be reduced if the display device employs such a drive at a low frequency.

CITATION LIST

Patent Literature

PTL 1: JP 2006-84758 A
PTL 2: JP 2017-161945 A

SUMMARY

Technical Problem

However, if the above-described active matrix type display device is driven at a low frequency, there is a problem in that flicker tends to occur.

Solution to Problem

Therefore, to solve the above-described problems, in a method of driving a display device according to the disclosure, the display device includes pixels arranged in a matrix, an electro-optical element included in each of the pixels, the electro-optical element configured to receive, from an anode, a current from a drive power supply and emit light, a cathode being connected to a cathode power supply in the electro-optical element, a connection line formed along a horizontal direction for each row of the matrix, the connection line configured to drive at a specific frequency one frame formed by the pixels included in the matrix, a data line formed along a vertical direction for each column of the matrix, a drive transistor connected in series between the drive power supply and the electro-optical element, the drive transistor configured to cause a drive current corresponding to a gate potential to flow from the drive power supply to the electro-optical element, a first connection transistor including a gate connected to the connection line, the first connection transistor configured to control whether to supply a data signal from the data line to a gate of the drive transistor, and a capacitance inserted and arranged between the gate of the drive transistor and the power supply. The method includes reducing a power supply voltage difference between the drive power supply and the cathode power supply when the one frame is driven in a second frequency drive compared to the power supply voltage difference when the one frame is driven in a first frequency drive, where the drive at the specific frequency being selectable from any one of the first frequency drive and the second frequency drive in which the one frame is driven at a frequency lower than in the first frequency drive.

It is also preferable that the reducing a power supply voltage difference includes increasing the cathode power supply. Furthermore, it is also preferable that the reducing a power supply voltage difference includes reducing a voltage of the drive power supply. Moreover, it is also preferable to reduce the power supply voltage difference by both increasing the cathode power supply and reducing the voltage of the drive power supply. In particular, the cathode power supply is increased more preferably because this does not require a change in a drive setting of the first frequency drive and the second frequency drive.

Furthermore, in the method of driving a display device, the second frequency drive is preferably a drive at 10 Hz to 45 Hz.

Furthermore, in the method of driving a display device, it is preferable that in the second frequency drive, a second frequency matrix formed by a region having a smaller area or a smaller number of pixels than the matrix is used as one frame.

Furthermore, it may be preferable that in the method of driving a display device, a source of the drive transistor is connected to a shared line connecting the drive power supply and the data line, and a source of the first connection transistor is connected between a drain of the drive transistor and the electro-optical element, the display device includes a first blocking transistor connected in series between the drive transistor and the drive power supply, a second blocking transistor being connected in series between the drive transistor and the electro-optical element, closer to the electro-optical element than a node relative to the first connection transistor, and having the same on-off operation as the first blocking transistor, a second connection transistor being connected in series between the drive transistor and the data line and having the same on-off operation as the first connection transistor, and an initialization transistor including a source connected between the first connection transistor and the capacitance. The method includes driving inversely on-off operations of the first blocking transistor and the second blocking transistor, and the first connection transistor and the second connection transistor, and turning off the initialization transistor at least while the drive current flows through the electro-optical element from a writing of the data signal into the capacitance during one frame period.

In this case, release of a leakage current from the capacitance while the drive current flows through the electro-optical element can be effectively suppressed by the first connection transistor and the initialization transistor that are turned off. Therefore, it is possible to further reduce luminance variation of the electro-optical element, particularly during the second frequency drive.

Therefore, to solve the above-described problems, a display device according to the disclosure includes pixels arranged in a matrix, an electro-optical element included in each of the pixels, the electro-optical element configured to receive, from an anode, a current from a drive power supply and emit light, a cathode being connected to a cathode power supply in the electro-optical element, a connection line formed along a horizontal direction for each row of the matrix, the connection line configured to drive at a specific frequency one frame formed by the pixels included in the matrix, a data line formed along a vertical direction for each column of the matrix, a drive transistor connected in series between the drive power supply and the electro-optical element, the drive transistor configured to cause a drive current corresponding to a gate potential to flow from the drive power supply to the electro-optical element, a first connection transistor including a gate connected to the connection line, the first connection transistor configured to control whether to supply a data signal from the data line to a gate of the drive transistor, and a capacitance inserted and arranged between the gate of the drive transistor and the drive power supply, the data signal supplied via the first connection transistor being written into the capacitance, the drive at the specific frequency being selectable from any one of a first frequency drive and a second frequency drive, and a power supply voltage difference between the drive power supply and the cathode power supply when the one frame is driven in the second frequency drive being smaller than a power supply voltage difference when the one frame is driven in the first frequency drive.

In the display device, it is also preferable to reduce the power supply voltage difference by increasing the cathode power supply. Furthermore, it is also preferable to reduce the power supply voltage difference by decreasing the voltage of the drive power supply. Moreover, it is also preferable to reduce the power supply voltage difference by decreasing the voltage of the drive power supply together with increasing the cathode power supply.

In the method of driving a display device, the second frequency drive is preferably a drive at 0.1 Hz to 45 Hz, is preferably a drive at 1 Hz to 45 Hz, or is preferably a drive at 10 Hz to 45 Hz, and is more preferably a drive at 30 Hz to 45 Hz. Furthermore, in some instances, the second frequency drive may be a drive at 0.1 Hz to 10 Hz, and may preferably be a drive at 0.1 Hz to 1 Hz.

This is because, if a drive frequency is lower than 0.1 Hz, it may not be possible to sufficiently suppress an influence of a factor causing flicker. This is because, if the drive frequency is higher than 45 Hz, the frequency is sufficiently high, and thus, flicker is unlikely to be a problem. If a range of the drive frequency is set to 30 Hz to 45 Hz, a sufficient effect of reducing power consumption can be expected, and thus, this range is useful as a drive region. Therefore, if the disclosure is applied in the range of 30 Hz to 45 Hz, it is possible to realize a driving method capable of providing an effect of improving visibility by reducing flicker in addition to an effect of reducing power consumption.

A display device may be driven at a very low drive frequency of 0.1 Hz to 10 Hz or 0.1 Hz to 1 Hz, and in such a case, the effect of reducing power consumption according to the disclosure can be expected.

Furthermore, in the display device, it is also preferable that in the second frequency drive, a second frequency matrix formed by a region having a smaller area or a smaller number of pixels than the matrix is used as one frame.

A display portion of the second frequency matrix corresponding to one frame visually recognized as an image is small, and thus, an effect of suppressing flicker can be improved compared to a case where the second frequency drive is performed on the entire screen.

In the second frequency matrix, a case is assumed where a screen is displayed that includes a clock function in a region formed by a smaller area or by a smaller number of pixels than the matrix, and the like. In this case, it is preferable that an electro-optical element in a matrix portion other than the second frequency matrix is turned off.

The second frequency matrix may move within the matrix whenever a specific time period elapses.

Furthermore, it may be preferable that in the display device, a source of the drive transistor is connected to a shared line connecting the drive power supply and the data line, and a source of the first connection transistor is connected between a drain of the drive transistor and the electro-optical element, the display device includes a first blocking transistor connected in series between the drive transistor and the drive power supply, a second blocking transistor being connected in series between the drive transistor and the electro-optical element, closer to the electro-optical element than a node relative to the first connection transistor, and having the same on-off operation as the first blocking transistor, a second connection transistor being connected in series between the drive transistor and the data line and having the same on-off operation as the first connection transistor, and an initialization transistor including a source connected between the first connection transistor and the capacitance, on-off operations of the first blocking transistor and the second blocking transistor, and the first connection transistor and the second connection transistor are driven inversely, and the initialization transistor is turned off at least while the drive current flows through the electro-optical element from a writing of the data signal into the capacitance during one frame period.

In this case, release of a leakage current from the capacitance while the drive current flows through the electro-optical element can be effectively suppressed by the first connection transistor and the initialization transistor that are turned off. Therefore, it is possible to further reduce luminance variation of the electro-optical element, particularly during the second frequency drive.

The display device according to the disclosure can be applied to an information terminal such as a mobile phone, a tablet type terminal, a car navigation system, or a personal computer, or a moving image display device such as a television, a video recorder, or a video player. The disclosure is not limited to these applications and can be widely applied.

Advantageous Effects of Disclosure

According to the present invention, occurrence of flicker can be effectively suppressed during a second frequency drive.

The disclosure includes a first connection transistor and an initialization transistor having a source connected between the first connection transistor and the capacitance, and thus, it is possible to effectively prevent a loss of charge from a holding capacitance held in the capacitance during the second frequency drive. Therefore, the effect of suppressing the luminance variation of the electro-optical element can be enhanced, and occurrence of flicker can be suppressed more effectively.

DESCRIPTION OF EMBODIMENTS

Figure 1:
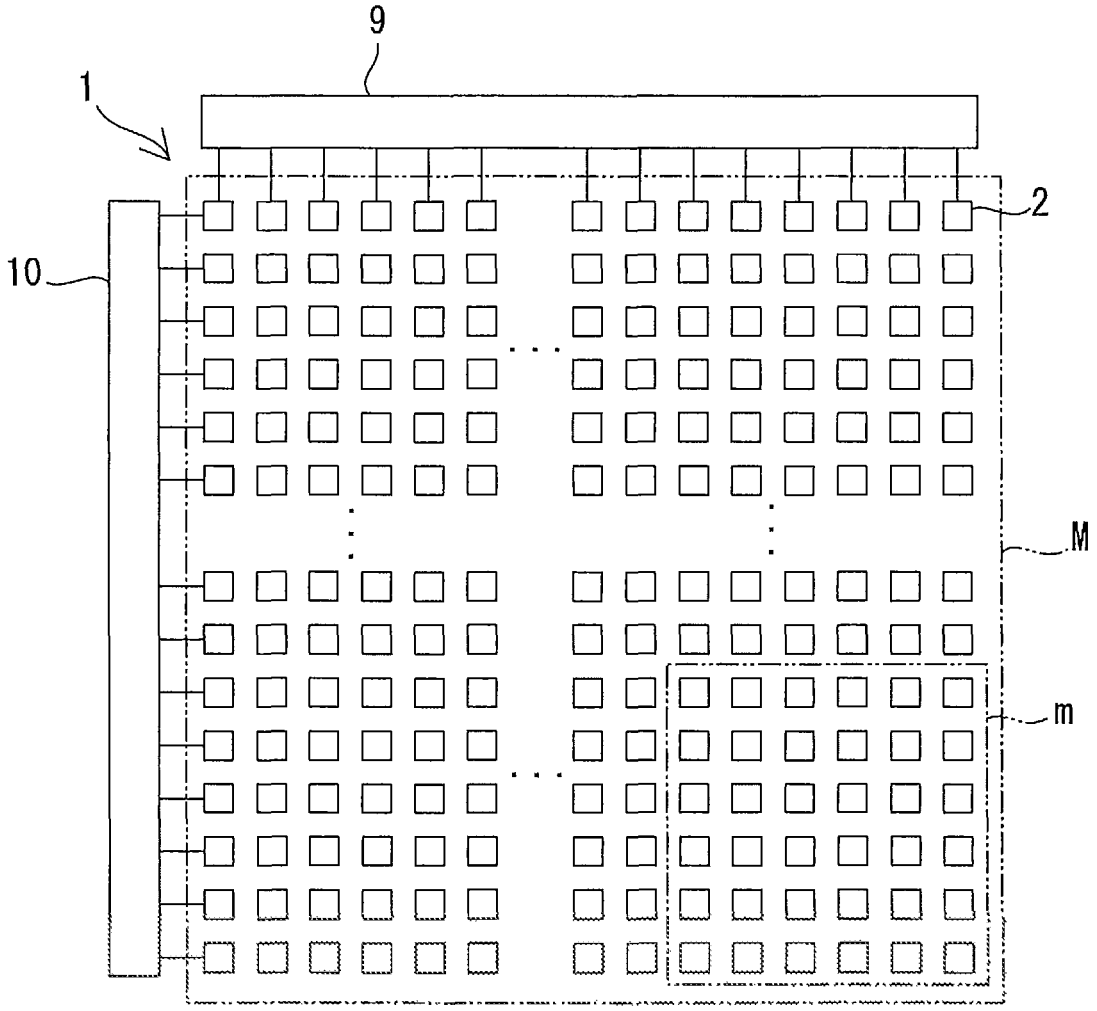
FIG. 1 is a diagram illustrating an overview of a display device 1 in which pixels 2 are arranged in a matrix, and drive units 9 and 10 that perform drive control of the pixels 2.

An embodiment according to the disclosure will be described below in detail with reference to the drawings. Note that, in the present specification and the drawings, constituent elements having substantially the same functional configuration will be given the same reference numerals, and duplicate description will be omitted.

FIG. 1 illustrates a schematic diagram of a display apparatus including a display device 1 common to a first embodiment and a second embodiment described below. The display apparatus includes pixels 2 arranged in a matrix M having rows in a horizontal direction and columns in a vertical direction, and a vertical drive unit 9 and a horizontal drive unit 10 that are connected to each of the pixels 2 and perform drive control of each of the pixels 2. The vertical drive unit 9 controls supply of a drive voltage ELVDD from a drive power supply (anode power supply) 3 to the pixels 2, and performs on-off control of a connection transistor. On the other hand, the horizontal drive unit 10 performs control for writing a data signal D into each of the pixels 2.

First Embodiment

Figure 2:
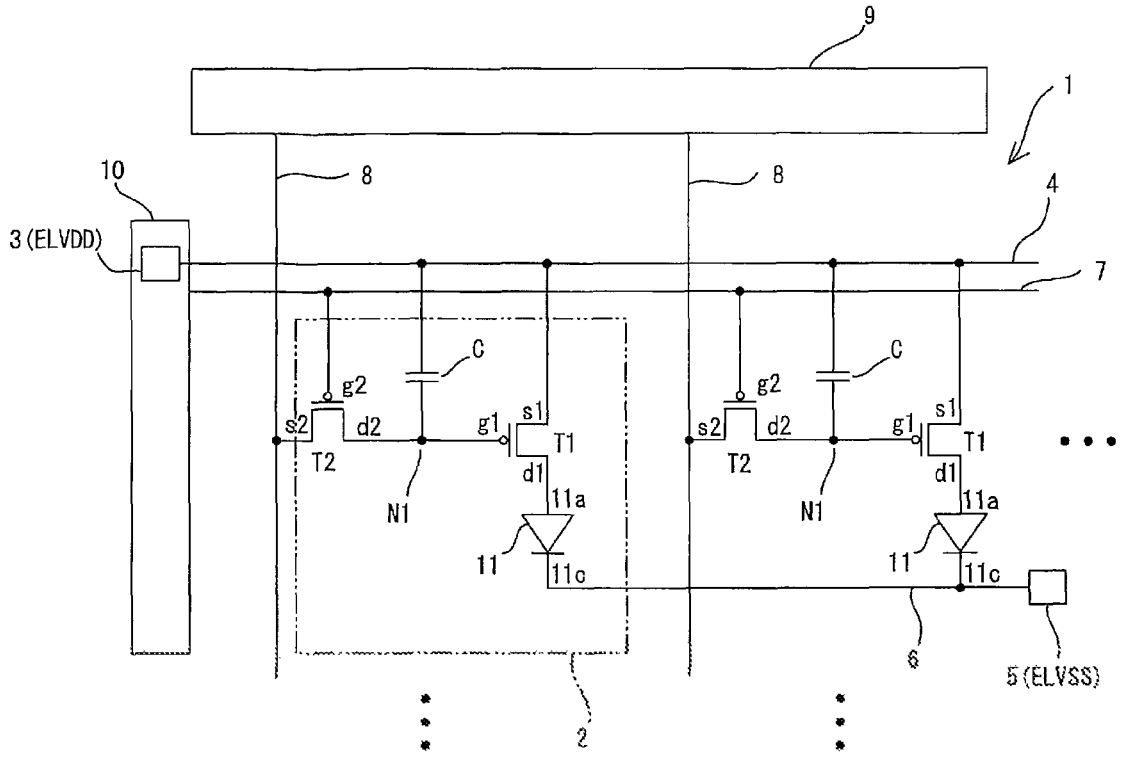
FIG. 2 is a diagram illustrating a circuit structure of the display device 1 according to a first embodiment.

FIG. 2 is an enlarged circuit diagram of a part of the display device 1 including the pixels 2 included in the matrix M in FIG. 1. In FIG. 2, the pixel 2, the drive power supply line 4 connected to the drive power supply 3, a cathode power supply line 6 connected to a cathode power supply 5, the connection line 7, and the data line 8 are provided. The connection line 7 is formed along the horizontal direction for each row of the matrix M. The connection line 7 drives one frame formed by the pixels 2 included in the matrix M at a specific frequency. The data line 8 is formed along the vertical direction for each column of the matrix M.

The pixel 2 includes an organic EL element 11 serving as an electro-optical element, a drive transistor T1, a first connection transistor T2, and a capacitor C serving as a capacitance.

The organic EL element 11 receives, from an anode 11*a* via the drive power supply line 4, a current from the drive power supply 3 to emit light, and a cathode 11*c* is connected to the cathode power supply 5 via the cathode power supply line 6.

The drive transistor T1 is connected in series between the drive power supply 3 and the organic EL element 11. The drive transistor T1 causes a drive current Id corresponding to a potential of a gate g1 to flow from the drive power supply 3 to the organic EL element 11.

In the first connection transistor T2, a gate g2 is connected to the connection line 7, a source s2 is connected to the data line 8, and a drain d2 is connected to the gate g1 of the drive transistor T1. The first connection transistor T2 controls, according to a signal from the connection line 7, whether the data signal D from the data line 8 is supplied to the gate g1 of the drive transistor T1.

The capacitor C is inserted and arranged between the gate g1 of the drive transistor T1 and the drive power supply 3. The data signal D supplied via the first connection transistor T2 can be written into the capacitor C.

Next, an operation of the display device 1 according to the present embodiment will be described.

If a voltage signal is applied to the first connection transistor T2 from the connection line 7, the data signal D from the data line 8 is written into the capacitor C as data voltage Vdata. After the writing of the data signal D into the capacitor C is completed, the application of the signal voltage from the connection line 7 is stopped, the first connection transistor T2 is blocked, and the data voltage Vdata is held on a side of a node N1 of the capacitor C.

The data voltage Vdata is applied to the gate g1 to turn on the drive transistor T1. Next, the drive current Id flows from the drive power supply 3 to the organic EL element 11 via the drive transistor T1, and thus, the organic EL element 11 emits light. The drive current Id flows from the cathode power supply line 6 to the cathode power supply 5 through the organic EL element 11.

Next, a method of driving the display device 1 according to the present embodiment will be described.

The display device 1 can form an image on the matrix by periodically scanning the matrix with the connection line 7 at a specific frequency in a column direction. The method of driving the display device 1 at a specific frequency includes high frequency drive (first frequency drive) ω1 and low frequency drive (second frequency drive) ω2 in which the display device 1 is driven at a lower frequency than in the high frequency drive ω1. The display device 1 can select any one of the high frequency drive ω1 and the low frequency drive ω2 under a predetermined condition.

During a normal operation such as an operation performed in a case where information is displayed on the display device 1 and a user actively attempts to acquire the information, the information needs to be displayed at high luminance to improve the visibility of the information. Thus, a power supply voltage difference Vdif between a cathode voltage ELVSS and the drive voltage ELVDD needs to be increased. Furthermore, during the normal operation, the display device 1 is driven in the high frequency drive ω1 to accurately display image information, such as moving images, having large changes in time. In the present embodiment, the display device 1 is driven at 60 Hz in the high frequency drive ω1.

On the other hand, during an information reduction operation such as an operation during a standby time period during which the user does not actively acquire information, it is not necessary to display an image having large changes in time on the display device 1. During the information reduction operation, the display device 1 is preferably driven in the low frequency drive ω2 to reduce power consumption. In the present embodiment, the display device 1 is driven at 30 Hz in the low frequency drive ω2.

However, if the display device 1 is driven with the same power supply voltage difference Vdif as that during the normal operation even during the information reduction operation in which the display device 1 is driven in the low frequency drive ω2, a time period during which the data voltage Vdata is retained the capacitor C is long, and thus, the amount of current leakage from the capacitor C is larger than in the case of the high frequency drive ω1. Therefore, if, even during the information reduction operation, the display device 1 is driven with the same power supply voltage difference Vdif as that during the normal operation, the variation in the data voltage Vdata generated during display of one frame is a factor in a luminance decrease that can be visually sensed by the user. When a next frame is displayed, a new data voltage Vdata is written so that it returns to a high luminance. The luminance decreases again until immediately before a next frame after the next frame is displayed, and thus, a luminance change between high and low luminances repeatedly will occur. These repeated changes between high and low luminances result in flicker, which strongly deteriorates the visibility of an image displayed on a screen.

Figure 4:
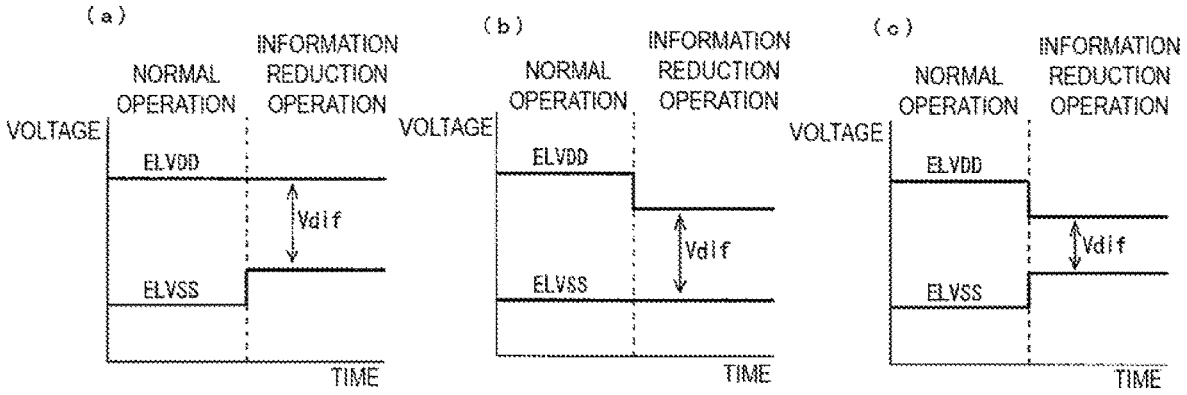
FIG. 4 is graphical representations illustrating an overview in which a power supply voltage difference Vdif is controlled in a low frequency drive ω2 according to the disclosure. (a) illustrates a case where a cathode voltage ELVSS is increased while a drive voltage ELVDD is maintained constant, (b) illustrates a case where the drive voltage ELVDD is decreased while the cathode voltage ELVSS is maintained constant, and (c) illustrates a case where the drive voltage ELVDD is decreased and the cathode voltage ELVSS is increased.

Therefore, in the present embodiment, a method of driving the display device 1 with low power consumption while the occurrence of flicker is suppressed is realized by increasing the voltage of the cathode voltage ELVSS compared to a case where the display device 1 is driven in the high frequency drive ω1, and decreasing the power supply voltage difference Vdif, while the drive voltage ELVDD is maintained constant as illustrated in FIG. 4(*a*), if the display device 1 is driven in the low frequency drive ω2.

Note that, an effect of suppressing occurrence of flicker is also exhibited if, in order to reduce the power supply voltage difference Vdif, the drive voltage ELVDD is reduced while the cathode voltage ELVSS is maintained constant compared to the case where the display device 1 is driven in the high frequency drive ω1, as illustrated in FIG. 4(*b*).

Furthermore, an effect of suppressing occurrence of flicker is also obtained if, in order to reduce the power supply voltage difference Vdif, the drive voltage ELVDD is reduced and the cathode voltage ELVSS is increased, compared to the case where the display device 1 is driven in the high frequency drive ω1, as illustrated in FIG. 4(*c*).

Here, in order to obtain an effect in which the display device 1 can be driven with low power consumption, it is preferable to maintain the drive voltage ELVDD constant, while increasing the voltage of the cathode voltage ELVSS compared to the case where the display device 1 is driven in the high frequency drive ω1 to reduce the power supply voltage difference Vdif, as illustrated in FIG. 4(*a*). This is because an effect of reducing power consumption can be obtained without requiring an adjustment of the data voltage Vdata for a change in luminance resulting from a reduction of the drive voltage ELVDD.

When the display device 1 is driven in the low frequency drive ω2, the frequency is preferably 10 Hz to 45 Hz.

Furthermore, when the display device 1 is driven in the low frequency drive ω2 during the information reduction operation, it is possible to use, for one frame, a low frequency (second frequency) matrix m formed of a region having a small area and a smaller number of pixels than the entire matrix M illustrated in FIG. 1 in the case where the display device 1 is driven in the high frequency drive ω1 during the normal operation.

Second Embodiment

Figure 3:
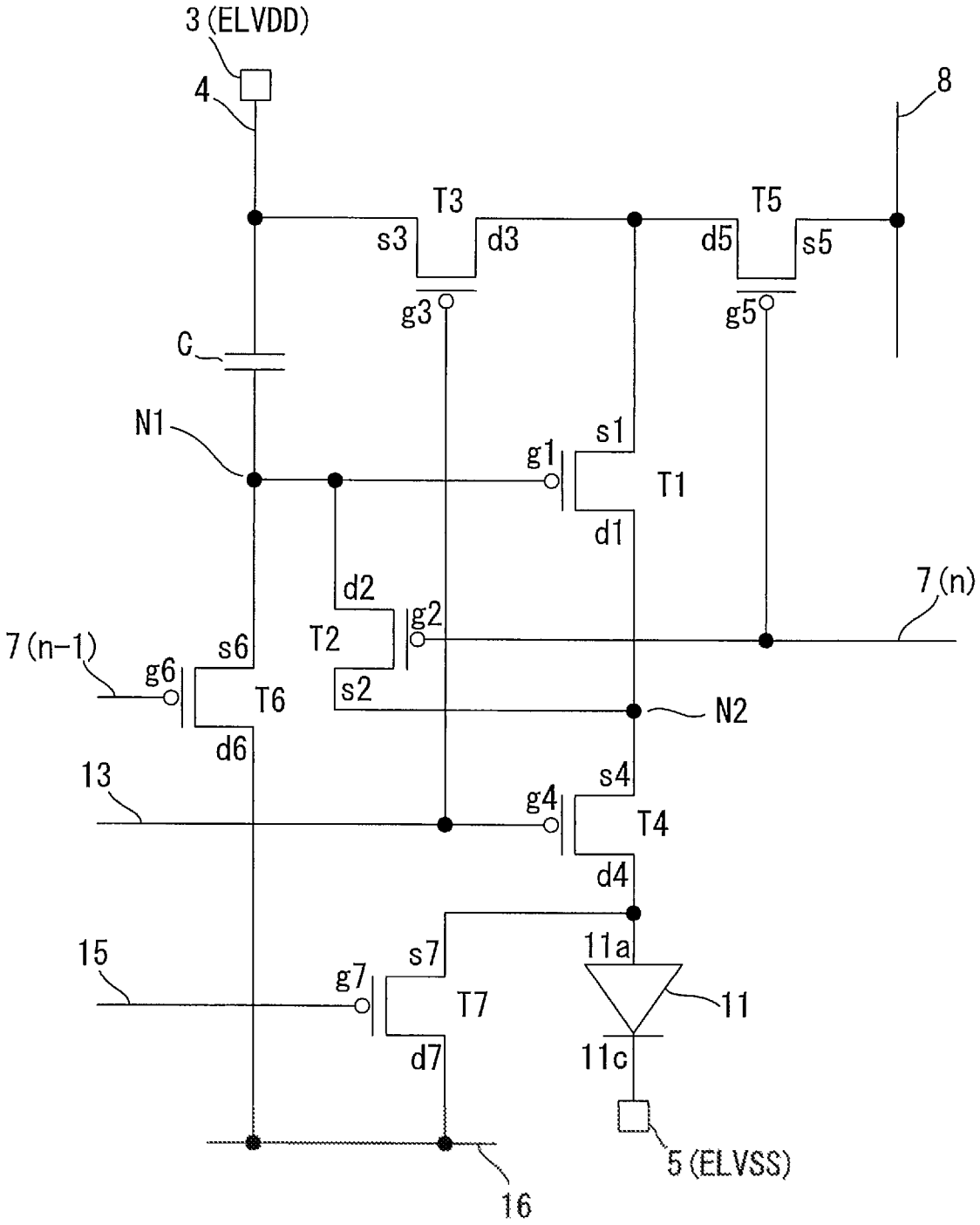
FIG. 3 is a diagram illustrating a circuit structure of the display device 1 according to a second embodiment.

FIG. 3 is a circuit diagram illustrating another embodiment of the display device 1 including the pixels 2 forming the matrix M in FIG. 1.

In FIG. 3, similarly to the first embodiment, the pixel 2, the drive power supply line 4 connected to the drive power supply 3, the cathode power supply line 6 connected to the cathode power supply 5, a connection line 7(*n*), and the data line 8 are provided. The connection line 7 is formed along the horizontal direction for each row of the matrix M. The connection line 7 drives one frame formed by the pixels 2 included in the matrix M at a specific frequency. The data line 8 is formed along the vertical direction for each column of the matrix M.

The pixel 2 includes the organic EL element 11 serving as the electro-optical element, the drive transistor T1, the first connection transistor T2, and the capacitor C serving as a capacitance.

The organic EL element 11 receives, from the anode 11*a* via the drive power supply line 4, a current from the drive power supply 3 to emit light, and the cathode 11*c* is connected to the cathode power supply 5 via the cathode power supply line 6.

The drive transistor T1 is connected in series between the drive power supply 3 and the organic EL element 11. The drive transistor T1 causes a drive current Id corresponding to a potential of a gate g1 to flow from the drive power supply 3 to the organic EL element 11.

In the first connection transistor T2, the gate g2 is connected to the connection line 7(*n*), the source s2 is connected to the data line 8, and the drain d2 is connected to the gate g1 of the drive transistor T1. The first connection transistor T2 controls, according to a signal from the connection line 7(*n*), whether the data signal D from the data line 8 is supplied to the gate g1 of the drive transistor T1.

Furthermore, in the present embodiment, a source s1 of the drive transistor T1 is connected to a shared line 12 connecting the drive power supply 3 and the data line 8, and the source s2 of the first connection transistor T2 is connected between a drain d1 of the drive transistor T1 and the organic EL element 11.

A first blocking transistor T3 is connected in series and arranged between the drive transistor T1 and the drive power supply 3.

A second blocking transistor T4 that is connected in series closer to the organic EL element 11 than a node N2 relative to the first connection transistor T2 and has the same on-off operation as the first blocking transistor T3, is arranged between the drive transistor T1 and the organic EL element 11. In the present embodiment, a gate g3 of the first blocking transistor T3 and a gate g4 of the second blocking transistor T4 are both connected to a blocking line 13.

A second connection transistor T5 having the same on-off operation as the first connection transistor T2 is arranged between the drive transistor T1 and the data line 8. In the present embodiment, a gate g5 of the second connection transistor T5 is connected to the connection line 7(*n*), similarly to the gate g2 of the first connection transistor T2.

An initialization transistor T6 to which a source s6 is connected is arranged between the first connection transistor T2 and the capacitor C. A gate g6 of the initialization transistor T6 is connected to a connection line 7(*n*-1) that applies a voltage for performing the on-off operation of the initialization transistor T6. The connection line 7(*n*-1) is a line that scans, before the line 7(*n*), pixels included in a row adjacent to the connection line 7(*n*). Here, n is an integer.

Here, the on-off operations of the first blocking transistor T3 and the second blocking transistor T4, and the first connection transistor T2 and the second connection transistor T5 are driven inversely.

The capacitor C is inserted and arranged between the gate g1 of the drive transistor T1 and the drive power supply 3. The data signal D supplied via the first connection transistor T2 can be written into the capacitor C.

The initialization transistor T6 is turned off while the drive current Id flows through the organic EL element 11 from the writing of the data signal D into the capacitor C during at least one frame period.

Note that a source s7 of an initialization transistor T7 is connected between the second blocking transistor T4 and the organic EL element 11. An initialization line 15 is connected to a gate g7 of the initialization transistor T7. A drain d6 of the initialization transistor T6 and a drain d7 of the initialization transistor T7 are connected to an initial voltage line 16.

Next, an operation of the display device 1 according to the present embodiment will be described.

If a signal voltage is applied from the connection line 7(*n*), the first connection transistor T2 and the second connection transistor T5 are turned on. At this time, the first blocking transistor T3 and the second blocking transistor T4 connected to the blocking line 13 are turned off. As a result, an outflow of the data signal D from the data line 8 to the drive power supply line 4 is blocked.

Furthermore, the initialization transistor T6 connected to the connection line 7(*n*-1) is also turned off. This blocks a leakage current from the capacitor C in which writing of the data signal D is completed, to the initial voltage line 16.

Accordingly, the data signal D as the data voltage Vdata is written into the capacitor C from the data line 8 via the shared line 12 and the drive transistor T1. After the completion of the writing of the data signal D into the capacitor C, the application of the signal voltage from the connection line 7(*n*) is stopped, the first connection transistor T2 and the second connection transistor T5 are blocked, and the data voltage Vdata is held by the capacitor C.

The data voltage Vdata is applied to the gate g1 to turn on the drive transistor T1. Subsequently, when the first blocking transistor T3 and the second blocking transistor T4 that are turned off are turned on, the drive current Id flows from the drive power supply 3 to the organic EL element 11 via the drive transistor T1, and thus, the organic EL element 11 emits light. The drive current Id flows from the cathode power supply line 6 to the cathode power supply 5 through the organic EL element 11.

During one frame period, after the drive current flows through the organic EL element 11, the first blocking transistor T3 and the second blocking transistor T4 are turned off, and the initialization transistor T6 and the initialization transistor T7 are turned on. Therefore, a voltage of a terminal on a side of the first connection transistor T2 of the capacitor C and a voltage of the anode 11*a* of the organic EL element 11 are returned to an initial voltage *Vini*.

Next, a method of driving the display device 1 according to the present embodiment will be described.

The display device 1 can form an image on the matrix by periodically scanning the matrix with the connection line 7(*n*) at a specific frequency in the column direction. The method of driving the display device 1 at a specific frequency includes the high frequency drive ω1 and the low frequency drive ω2 having a lower frequency than the high frequency drive ω1. The display device 1 can select any one of the high frequency drive ω1 and the low frequency drive ω2 under a predetermined condition.

During a normal operation such as an operation performed in a case where information is displayed on the display device 1 and a user actively attempts to acquire the information, the information needs to be displayed at high luminance to improve the visibility of the information. Thus, a power supply voltage difference Vdif between the cathode voltage ELVSS and the drive voltage ELVDD needs to be increased. Furthermore, during the normal operation, the display device 1 is driven in the high frequency drive ω1 to accurately display image information, such as moving images, having large changes in time. In the present embodiment, the display device 1 is driven at 60 Hz in the high frequency drive ω1.

On the other hand, during an information reduction operation such as an operation during a standby time period during which the user does not actively acquire information, it is not necessary to display an image having large changes in time on the display device 1. During the information reduction operation, the display device 1 is preferably driven in the low frequency drive ω2 to reduce power consumption. In the present embodiment, the display device 1 is driven at 30 Hz in the low frequency drive ω2.

However, if the display device 1 is driven with the same power supply voltage difference Vdif as that during the normal operation even during the information reduction operation in which the display device 1 is driven in the low frequency drive ω2, a time period during which the data voltage Vdata is retained the capacitor C is long, and thus, the amount of current leakage from the capacitor C is larger than in the case of the high frequency drive ω1. Therefore, if, even during the information reduction operation, the display device 1 is driven with the same power supply voltage difference Vdif as that during the normal operation, the variation in the data voltage Vdata generated during display of one frame is a factor in a luminance decrease that can be visually sensed by the user. When a next frame is displayed, a new data voltage Vdata is written so that it returns to a high luminance. The luminance decreases again until immediately before a next frame after the next frame is displayed, and thus, a luminance change between high and low luminances repeatedly will occur. These repeated changes between high and low luminances result in flicker, which strongly deteriorates the visibility of the image displayed on the screen.

Therefore, in the present embodiment, a method of driving the display device 1 with low power consumption while the occurrence of flicker is suppressed is realized by increasing the voltage of the cathode voltage ELVSS compared to a case where the display device 1 is driven in the high frequency drive ω1, and decreasing the power supply voltage difference Vdif, while the drive voltage ELVDD is maintained constant as illustrated in FIG. 4(*a*), if the display device 1 is driven in the low frequency drive ω2.

Figure 5:
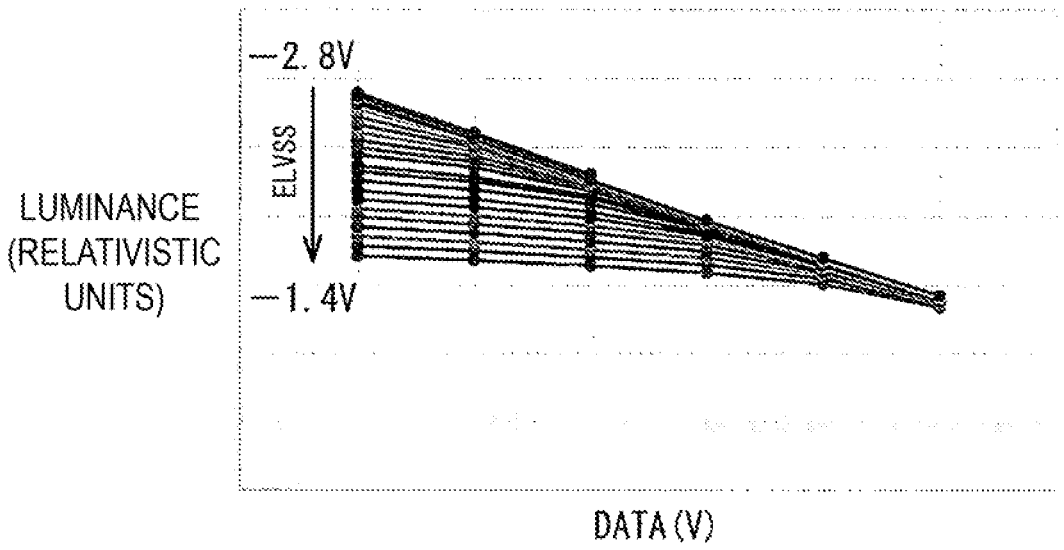
FIG. 5 is a graph illustrating an effect of suppressing occurrence of flicker according to a change in luminance obtained from a matrix with respect to a data voltage Vdata in the second embodiment.

FIG. 5 illustrates an effect of suppressing occurrence of flicker according to a change in luminance obtained from a matrix with respect to the data voltage Vdata in the present embodiment. The plurality of graphs in FIG. 5 illustrate a change in luminance at each cathode voltage ELVSS when the cathode voltage ELVSS is changed from −2.8 V to −1.4 V with respect to the drive voltage ELVDD being a fixed value. It can be seen that, by increasing the cathode voltage ELVSS to reduce the power supply voltage difference Vdif between the cathode voltage ELVSS and the drive voltage ELVDD, the change in luminance decreases and the occurrence of flicker can be suppressed.

As illustrated in FIG. 5, when the display device 1 is driven in the low frequency drive ω2, an effect of suppressing flicker is also obtained in a similar manner in the first embodiment if the power supply voltage difference Vdif is reduced compared to the case where the display device 1 is driven in the high frequency drive ω1.

However, in the case of the second embodiment, occurrence of leakage current while the drive current Id flows through the organic EL element 11 in one frame period can be suppressed by the first connection transistor T2 and the initialization transistor T6. That is, if the first connection transistor T2 and the initialization transistor T6 are provided, it is possible to further suppress occurrence of flicker compared to the first embodiment.

Note that, an effect of suppressing occurrence of flicker is also exhibited if, in order to reduce the power supply voltage difference Vdif, the drive voltage ELVDD is reduced while the cathode voltage ELVSS is maintained constant compared to the case where the display device 1 is driven in the high frequency drive ω1, as illustrated in FIG. 4(*b*).

Furthermore, an effect of suppressing occurrence of flicker is also obtained if, in order to reduce the power supply voltage difference Vdif, the drive voltage ELVDD is reduced and the cathode voltage ELVSS is increased, compared to the case where the display device 1 is driven in the high frequency drive ω1, as illustrated in FIG. 4(*c*).

When the display device 1 is driven in the low frequency drive ω2, the frequency is preferably 10 Hz to 45 Hz.

Furthermore, when the display device 1 is driven in the low frequency drive ω2 during the information reduction operation, it is possible to use, for one frame, the low frequency matrix m that is formed by a region having a small area and a smaller number of pixels than the entire matrix M illustrated in FIG. 1 in the case where the display device 1 is driven in the high frequency drive ω1 during the normal operation.

A display according to the present embodiment is not particularly limited as long as the display is a display panel including a display element. In the display element, luminance and transmittance of the display element are controlled by a current, and examples of the current-controlled display element include an organic electro luminescence (EL) display including an organic light emitting diode (OLED), and a QLED display including an EL display quantum dot light emitting diode (QLED) such as an inorganic EL display including an inorganic light emitting diode.

The invention claimed is:

1. A method of driving a display device including:

pixels arranged in a matrix;

an electro-optical element included in each of the pixels, the electro-optical element configured to receive, from an anode, a current from a drive power supply and emit light, a cathode being connected to a cathode power supply in the electro-optical element;

a connection line formed along a horizontal direction for each row of the matrix, the connection line configured to drive, at a specific frequency, one frame formed by the pixels included in the matrix;

a data line formed along a vertical direction for each column of the matrix;

a drive transistor connected in series between the drive power supply and the electro-optical element, the drive transistor configured to cause a drive current corresponding to a gate potential to flow from the drive power supply to the electro-optical element;

a first connection transistor including a gate connected to the connection line, the first connection transistor configured to control whether to supply a data signal from the data line to a gate of the drive transistor; and a capacitance inserted and arranged between the gate of the drive transistor and the drive power supply, the data signal supplied via the first connection transistor being written into the capacitance, wherein the method comprises reducing a power supply voltage difference between the drive power supply and the cathode power supply when the one frame is driven in a second frequency drive compared to the power supply voltage difference when the one frame is driven in a first frequency drive, where the drive at the specific frequency is selectable from any one of the first frequency drive and the second frequency drive in which the one frame is driven at a frequency lower than in the first frequency drive.

2. The method of driving a display device according to claim 1, wherein the reducing a power supply voltage difference includes increasing the cathode power supply.

3. The method of driving a display device according to claim 1, wherein the reducing a power supply voltage difference includes reducing a voltage of the drive power supply.

4. The method of driving a display device according to claim 1, wherein the second frequency drive is a drive at 10 Hz to 45 Hz.

5. The method of driving a display device according to claim 1, wherein in the second frequency drive, a second frequency matrix formed by a region having a smaller area or a smaller number of pixels than the matrix is used as one frame.

6. The method of driving a display device according to claim 1, wherein a source of the drive transistor is connected to a shared line connecting the drive power supply and the data line, a source of the first connection transistor is connected between a drain of the drive transistor and the electro-optical element, the display device comprises a first blocking transistor connected in series between the drive transistor and the drive power supply, a second blocking transistor being connected in series between the drive transistor and the electro-optical element, closer to the electro-optical element than a node relative to the first connection transistor, and having the same on-off operation as the first blocking transistor, a second connection transistor being connected in series between the drive transistor and the data line and having the same on-off operation as the first connection transistor, and an initialization transistor including a source connected between the first connection transistor and the capacitance, and the method comprises driving inversely on-off operations of the first blocking transistor and the second blocking transistor, and the first connection transistor and the second connection transistor, and turning off the initialization transistor at least while the drive current flows through the electro-optical element from a writing of the data signal into the capacitance during one frame period.

7. A display device comprising:

pixels arranged in a matrix;

an electro-optical element included in each of the pixels, the electro-optical element configured to receive, from an anode, a current from a drive power supply and emit light, a cathode being connected to a cathode power supply in the electro-optical element;

a connection line formed along a horizontal direction for each row of the matrix, the connection line configured to drive one frame formed by the pixels included in the matrix at a specific frequency;

a data line formed along a vertical direction for each column of the matrix;

a drive transistor connected in series between the drive power supply and the electro-optical element, the drive transistor configured to cause a drive current corresponding to a gate potential to flow from the drive power supply to the electro-optical element;

a first connection transistor including a gate connected to the connection line, the first connection transistor configured to control whether to supply a data signal from the data line to a gate of the drive transistor; and a capacitance inserted and arranged between the gate of the drive transistor and the drive power supply, the data signal supplied via the first connection transistor being written into the capacitance, wherein the drive at the specific frequency is selectable from any one of a first frequency drive and a second frequency drive in which the one frame is driven at a frequency lower than the first frequency drive, and a power supply voltage difference between the drive power supply and the cathode power supply when the one frame is driven in the second frequency drive is smaller than the power supply voltage difference when the one frame is driven in the first frequency drive.

8. The display device according to claim 7, wherein the power supply voltage difference is reduced by increasing the cathode power supply.

9. The display device according to claim 7, wherein the power supply voltage difference is reduced by decreasing a voltage of the drive power supply.

10. The display device according to claim 7, wherein a source of the drive transistor is connected to a shared line connecting the drive power supply and the data line, a source of the first connection transistor is connected between a drain of the drive transistor and the electro-optical element, and the display device comprises a first blocking transistor connected in series between the drive transistor and the drive power supply, a second blocking transistor being connected in series between the drive transistor and the electro-optical element, closer to the electro-optical element than a node relative to the first connection transistor, and having the same on-off operation as the first blocking transistor, a second connection transistor being connected in series between the drive transistor and the data line and having the same on-off operation as the first connection transistor, an initialization transistor including a source connected between the first connection transistor and the capacitance, on-off operations of the first blocking transistor and the second blocking transistor, and the first connection transistor and the second connection transistor being driven inversely, and the initialization transistor being turned off at least while the drive current flows through the electro-optical element from a writing of the data signal into the capacitance during one frame period.

* * * * *